US006716018B2

(12) United States Patent
Abrego et al.

(10) Patent No.: US 6,716,018 B2
(45) Date of Patent: Apr. 6, 2004

(54) PELLETIZER KNIFE HUB TRANSPORT MECHANISM

(75) Inventors: Oscar Mario Abrego, Baytown, TX (US); Matthew Craig Elliott, Houston, TX (US); Rafael Errisuriz, Baytown, TX (US); James Mark McAlpin, Baytown, TX (US); Blake Ramsey, Mont Belvieu, TX (US); Tracie Wheeler, Baytown, TX (US); Bervick Simon, Sr., Baytown, TX (US); Jack Wishlinski, Houston, TX (US)

(73) Assignee: ExxonMobil Chemical Patents, Inc., Houston, TX (US)

( * ) Notice: Subject to any disclaimer, the term of this patent is extended or adjusted under 35 U.S.C. 154(b) by 0 days.

(21) Appl. No.: 10/370,811

(22) Filed: Feb. 20, 2003

(65) Prior Publication Data

US 2003/0161908 A1 Aug. 28, 2003

Related U.S. Application Data

(60) Provisional application No. 60/360,344, filed on Feb. 28, 2002.

(51) Int. Cl.[7] ..... B66C 1/24

(52) U.S. Cl. ..... 425/196; 425/311; 425/313; 294/81.3; 294/81.4; 294/67.21; 294/67.5

(58) Field of Search ..... 294/81.3, 81.4, 294/62.21, 67.5; 425/196, 311, 308, 310, 313

(56) References Cited

U.S. PATENT DOCUMENTS

| | | | | |
|---|---|---|---|---|
| 2,925,300 A | | 2/1960 | Kelley | 294/103 |
| 3,272,347 A | * | 9/1966 | Lemelson | 414/728 |
| 3,750,804 A | * | 8/1973 | Lemelson | 414/276 |
| 3,912,434 A | | 10/1975 | Nagahara et al. | 425/142 |
| 4,529,370 A | | 7/1985 | Holmes et al. | 425/142 |
| 4,759,674 A | | 7/1988 | Schroder et al. | 414/146 |
| 5,059,103 A | | 10/1991 | Bruckmann et al. | 425/67 |
| 5,088,610 A | | 2/1992 | Garnier | 212/196 |
| 5,110,523 A | | 5/1992 | Guggiari | 264/40.5 |
| 5,146,831 A | | 9/1992 | Fetter, Jr. et al. | 83/698 |
| 5,190,768 A | | 3/1993 | Ishida et al. | 425/67 |
| 5,330,340 A | | 7/1994 | Suppon et al. | 425/142 |
| 5,378,004 A | | 1/1995 | Gunlock et al. | 280/47.2 |
| 5,386,971 A | | 2/1995 | Ingram | 264/148 |
| 5,456,587 A | | 10/1995 | Ingram | 425/168 |
| 5,596,251 A | | 1/1997 | Miller | 318/366 |
| 6,261,078 B1 | | 7/2001 | Martin | 425/192 R |
| 6,298,535 B1 | | 10/2001 | Lower | 29/273 |
| 6,332,765 B1 | | 12/2001 | Spelleken | 425/67 |
| 2002/0050724 A1 | * | 5/2002 | Tsimmerman | 294/67.5 |

FOREIGN PATENT DOCUMENTS

| | | |
|---|---|---|
| FR | 1498313 | 9/1967 |
| FR | 2403281 | 4/1979 |

* cited by examiner

*Primary Examiner*—Robert Davis
*Assistant Examiner*—Joseph S. Del Sole
(74) *Attorney, Agent, or Firm*—Andrew B. Griffis

(57) ABSTRACT

A mechanism for transporting a hub is provided. Particularly, a transport mechanism for a pelletizer knife hub is disclosed. The mechanism comprises a clamp for selectively engaging and releasing the shaft of the pelletizer knife hub. The clamp is connected to a support bar. The support bar, in turn, has a hoisting connector for being raised, lowered, and maneuvered by a hoisting system. According to the mechanisms of the present invention, the clamp is rotatable relative to the hoisting system. In one embodiment, a counter-balance to the hub is provided. In another arrangement, the hoisting system supports the hub above the hub for balancing the system.

22 Claims, 6 Drawing Sheets

Fig. 1
(Prior Art)
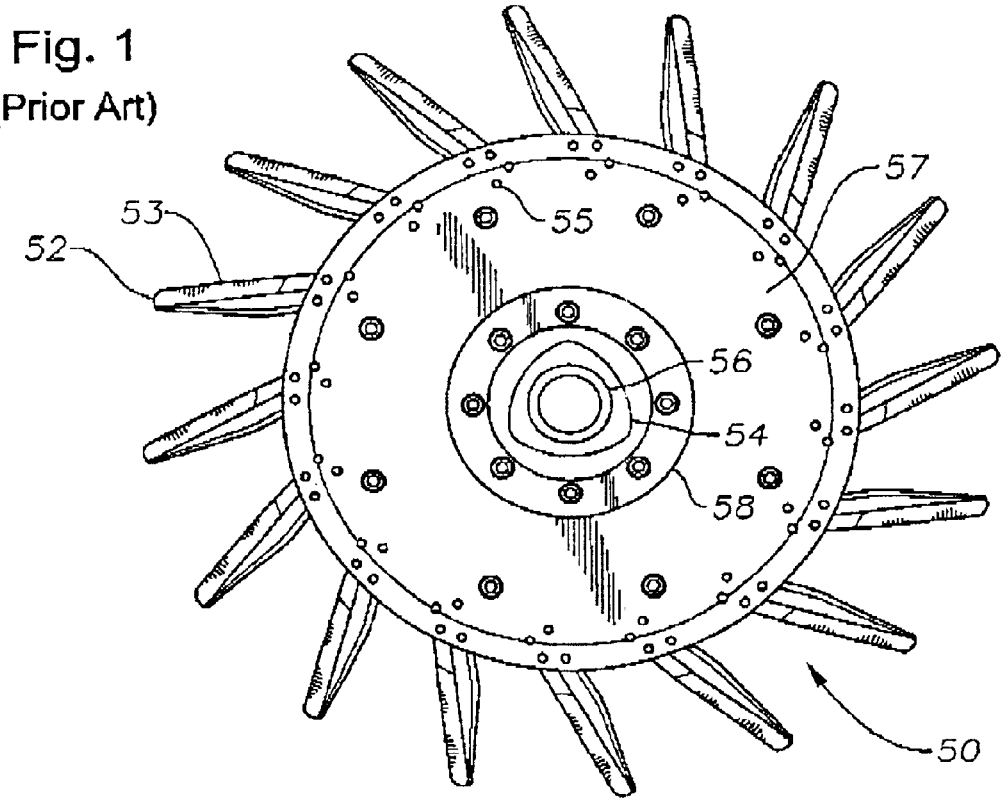
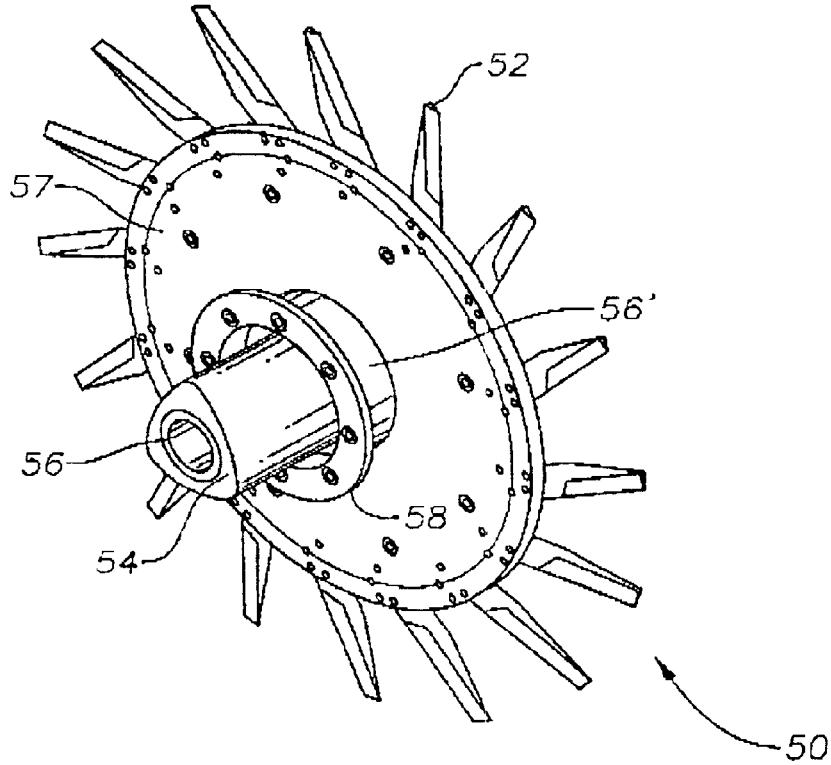
Fig. 2
(Prior Art)

PELLETIZER KNIFE HUB TRANSPORT MECHANISM

CROSS-REFERENCE TO RELATED APPLICATION

This application claims the benefit of U.S. Provisional Application Serial No. 60/360,344, filed Feb. 28, 2002.

BACKGROUND OF THE INVENTION

1. Field of the Invention

The present invention pertains to an apparatus for transporting a hub, including, for example, a mechanism for transporting a pelletizer knife hub.

2. Description of the Related Art

Many containers and other items are manufactured from plastics. Examples include motor oil containers, fruit juice containers, trash bags, tool covers, and many other items too numerous to list. These items are often manufactured through a molding, extrusion, or blowing process. The raw material typically used in the manufacturing process is provided in the form of pellets manufactured from a polymer, such as polyethylene.

Certain processes for manufacturing the pellets themselves involve the use of a pelletizer system. In many such systems, a melted plastic resin is forced through an extruder at high temperatures and pressures. The resin is forced through a die plate having up to 600 extrusion holes, with the resin being forced at pressures in excess of 600 psi. The extruded resin passes through the extrusion holes into an underwater chamber. The resin is then cut into small pieces by a series of knives which are rotated within the underwater chamber against the face of the die plate. As the resin is cut, it is cooled by circulated water, causing hardening of the material into numerous individual pellets. The pellets are then carried from the chamber downstream by the circulated water for drying and transport to customers.

FIG. 1 and FIG. 2 depict a known knife hub which is rotated within a pelletizer system. FIG. 1 presents a side view of a knife hub 50 as sold under the mark KOBE™. The knife hub 50 carries a plurality of knives 52 around its outer circumference. Each knife 52 has a blade surface 53 which rides closely along the die plate (not shown) in order to cut the resin. The blades are secured to the hub 50 by bolts 55 secured through the hub 50. Typically, 16 to 24 knives 52 are radially disposed about the outer circumference of the hub 50.

The hub 50 is rotated about a shaft 56. The shaft 56 typically comprises an outer polygonal surface 54 which mates to a rotary motor shaft (not shown). The shaft 56 is more fully seen in the perspective view of the hub 50 in FIG. 2.

The hub 50 also comprises a collar 58. The collar 58 is offset from a body 57 of the hub 50, leaving a gap between the collar 58 and the hub body 57. The portion of shaft 56 residing within the gap is shown in FIG. 2 at 56'. Shaft 56' is generally circular in cross-section in order to receive a clamp (shown in FIG. 3) for aid in transporting.

It is periodically necessary to remove the knife hub 50 in order to inspect, repair, or replace the knives 52. A pelletizer knife hub transport mechanism 10 is used to maneuver a pelletizer knife hub 50 into and out of service with a plastic resin pelletizer system.

FIG. 3 presents a perspective view of a known transport mechanism 10 as is used for transporting a pelletizer knife hub, such as hub 50 shown in FIG. 2. The known transport mechanism 10 provides an elongated rail 15. At one end of the rail 15 is a clamp 30. The clamp 30 includes opposite clamping members 32, 34 which are selectively opened and closed. T-bolt 38 aids in securing and releasing the opposite clamp members 32, 34 in order to open and close the clamp 30.

The clamp 30 is configured to engage the shaft 56' of the pelletizer knife hub 50, such as the hub 50 shown in FIGS. 1–2. To aid in transport, a hoisting system is needed. To this end, the known transport mechanism 10 provides a hoisting connector 24. The hoisting connector 24 defines a durable member fastened to the elongated rail 15 between the opposite ends. The hoisting connector 24 typically includes an eyelet 26 or other opening configured for receiving a hook 300. The hook 300 is connected to a hoisting system (not shown) such as a bridge crane, an arm crane, or even a stationary block and tackle for providing a mechanical advantage in maneuvering the transport mechanism 10. One or more cables 310 connect the hoisting hook 300 to the hoisting system.

To further aid in the transport of a pelletizer knife hub 50, a counter-weight 20 is provided. The counter-weight 20 is normally positioned proximate to the hoisting connector 24 when the transport mechanism 10 is not carrying a hub 50. However, the counter-weight 20 is slidable along the elongated rail 15 to the end opposite the clamp 30 when the clamp 30 engages the shaft 56' of the hub 50. In this way, the transport mechanism 10 is balanced.

A counter-weight connector 22 is provided in order to connect the counter-weight 20 to the elongated rail 15. The connector 22 is slidable along the elongated rail 15 in order to permit adjustment of the longitudinal position of the counter-weight 20. However, known counter-weight connectors 22 do not swivel relative to the elongated rail 15. Likewise, the hoisting system connector 24 does not swivel about the longitudinal rail 15.

Disadvantages have been encountered with use of the known transport mechanisms 10. First, it is necessary during the removal and maneuvering of a knife hub 50 to rotate the knife hub 50 from its operational vertical position to a horizontal position. In this respect, knife hubs are serviced and maintenanced while they are on a work stand in the horizontal position. This typically requires that the knife hub be placed manually onto the ground in the horizontal position for subsequent transport to a maintenance area. However, as noted, the known transport mechanisms 10 have no swiveling parts, making rotation of the knife hub 50 into a horizontal position difficult.

Those of ordinary skill in the art will further appreciate that the manipulation of a knife hub 50 is extremely difficult. In this respect, the knife hub typically weighs in excess of 100 pounds and cannot easily be manipulated by a single individual, even when supported by a transport mechanism 10. Use of the currently known transport mechanisms 10 necessarily requires at least some manual manipulation of the hub 50.

Other disadvantages have been encountered in connection with known transport mechanisms 10. For example, once a hub 50 has been removed from a pelletizer system and lowered to the ground, the clamp 30 must be removed. A crew removing a hub 50 will place the hub 50 on the ground in a horizontal position, with the clamp 30 on top of the hub 50. The hub 50 is then typically rotated manually 180 degrees in order to set the hub 50 within a transportation box or to perform maintenance on the hub. Additional manual manipulation is required during maintenance, including subsequent manual rotation of the hub 50 in order to reattach the hub to the clamp 30 after knives 52 are installed.

Examples of patents generally pertaining to apparatus that provide leverage for handling a device include U.S. Pat. Nos. 2,925,300; 4,759,674; and 5,088,610; French Patent Nos. 1,498,313; and 2,403,281. In particular U.S. Pat. Nos. 2,925, 300, 5,088,610; and FR 1,498,313 disclose a material handling device which is transported through an overhead conveyance system. However, a device including a clamp which will suitably engage a pelletizer knife hub in a sufficiently secure fashion to enable transport and manipulation of the hub is not suggested.

Thus, there is a need for an improved transport mechanism for a pelletizer knife hub. A need further exists for a pelletizer knife hub transport mechanism capable of rotating and otherwise manipulating a clamp while engaging the hub. Further, a need exists for a knife hub transport mechanism that swivels relative to the hoisting system.

SUMMARY OF THE INVENTION

Mechanisms and methods for transporting a hub are provided. For example, transport mechanisms for a pelletizer knife hub are disclosed. The mechanism first comprises a clamp for selectively engaging and releasing the shaft of the pelletizer knife hub. The clamp is connected to a support bar. The support bar, in turn, has a hoisting connector for being raised, lowered, and maneuvered by a hoisting system.

In certain embodiments of the present invention, the clamp is rotatable relative to the hoisting connector. In one embodiment, a counter-balance to the hub is provided. In another arrangement, the hoisting system supports the hub normally above the hub for balancing the system.

BRIEF DESCRIPTION OF THE DRAWINGS

So that the manner in which the above recited features are attained and can be understood in detail, a more particular description of the invention, briefly summarized above, may be had by reference to the embodiments thereof, which are illustrated in the appended drawings (FIGS. 4–8). It is to be noted, however, that the appended drawings illustrate only typical embodiments of this invention and are therefore not to be considered limiting of its scope, for the invention may admit to other equally effective embodiments.

FIG. 1 is a side elevation view of a known pelletizer knife hub. Visible in this view is the plurality of knives radially disposed about the outer circumference of the body of the hub.

FIG. 2 presents a perspective view of the known knife hub of FIG. 1. More fully seen in this view is the shaft arrangement for the hub.

DETAILED DESCRIPTION

Figure 3:
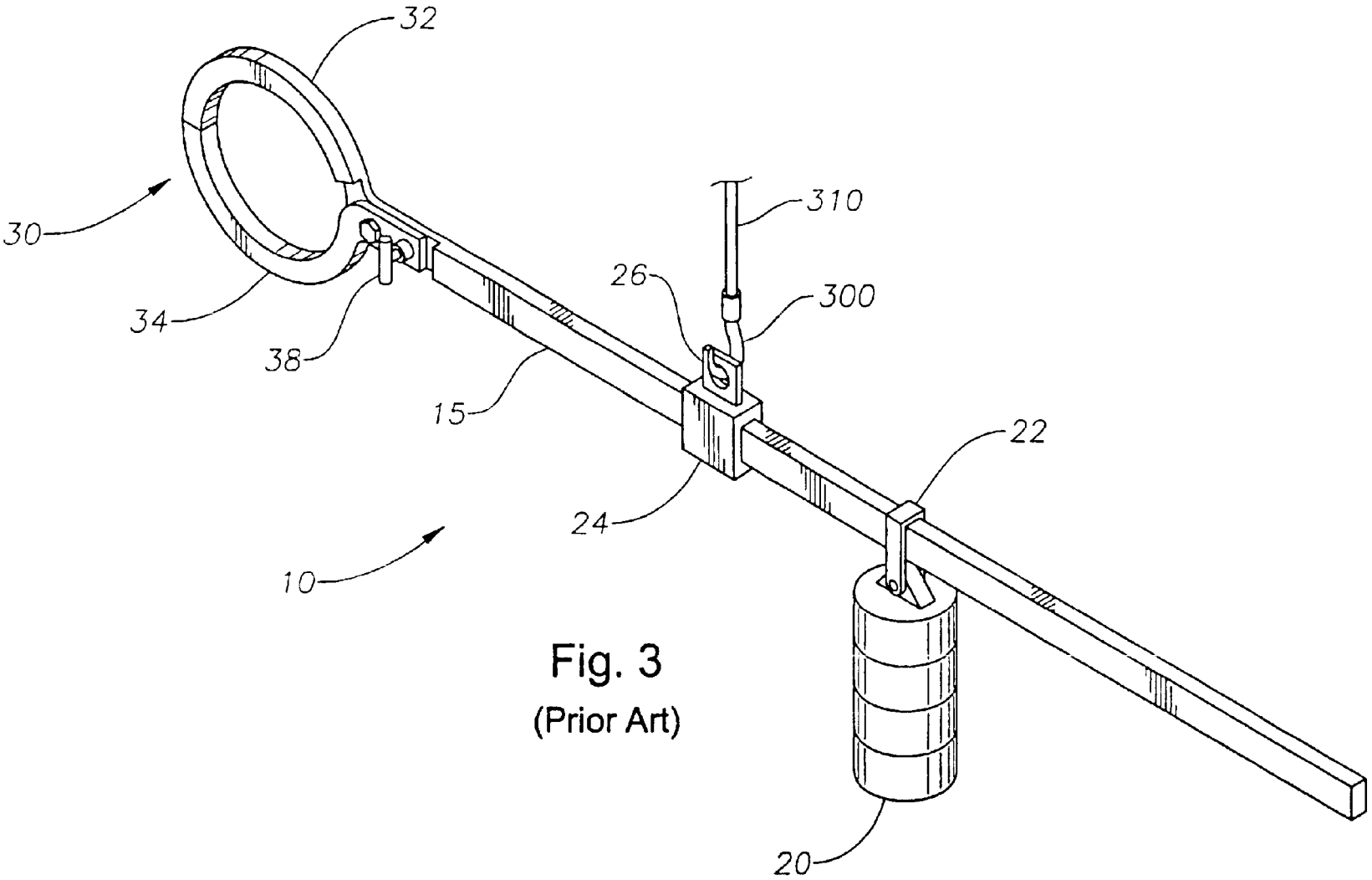
Fig. 3 (Prior Art)
FIG. 3 presents a perspective view of a pelletizer knife hub transport mechanism of the prior art.
Figure 4:
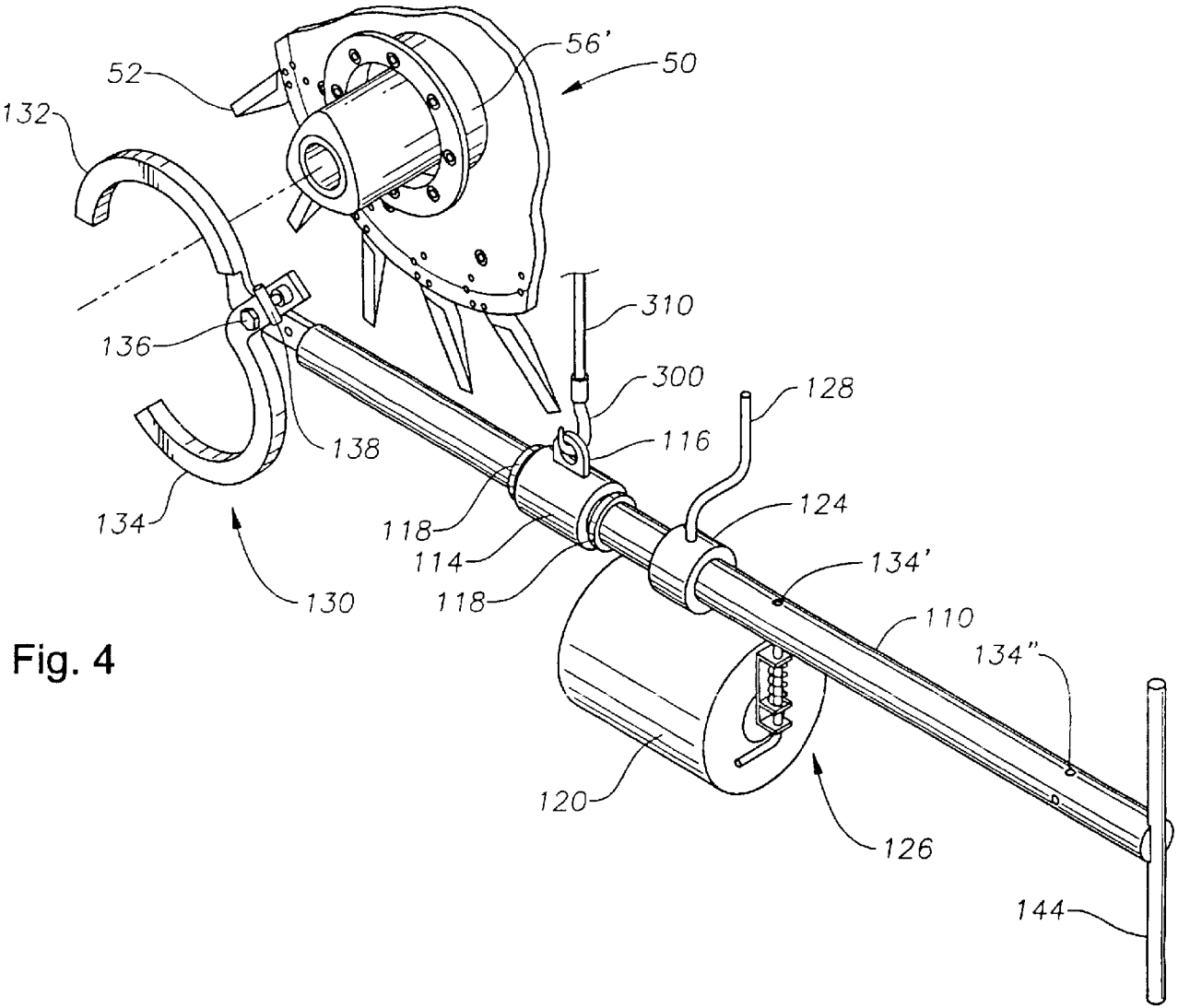
FIG. 4 presents a perspective view of a pelletizer knife hub transport mechanism. The elongated rail and accompanying connection parts have been replaced with an elongated bar and associated parts which permit ready rotation of the clamp and counter-weight relative to the hoisting system.

FIG. 4 presents a perspective view of a transport mechanism 100 of the present invention. The transport mechanism 100 is designed and configured to transport a knife hub 50 for a plastic resin pelletizer system (not shown) or other tool having a hub.

The transport mechanism 100 shown in FIG. 4 first comprises an elongated bar 110. In the arrangement of FIG. 4, the elongated bar 110 defines a tubular body having an essentially circular cross-section. The bar 110 is preferably fabricated from steel or other durable metal alloy composition. It is understood that the bar 110 must have sufficient strength to bear the moment of a knife hub 50 that weighs in excess of 100 pounds.

The transport mechanism 100 further comprises a hoisting connector 114. The hoisting connector resides on the elongated bar 110 intermediate to opposite ends of the bar 110. The hoisting connector 114 is configured to receive a hook 300 or other connector from a hoisting system (not shown). It is understood that the hoisting system includes one or more cables, chains, or ropes, likely drawn through a block-and-tackle or other system for obtaining a mechanical lifting advantage. In the arrangement of FIG. 4, a cable 310 is shown. It is understood, however, that the transport mechanism 100 is not limited by any particular type of hoisting system.

Various configurations for a hoisting connector 114 may be employed. In the arrangement shown in FIG. 4, a bushing 114 is used as the hoisting connector. The bushing 114 is concentrically disposed about the elongated bar 110. At the same time, the bushing 114 is configured to be able to rotate about the bar 110. Optional retaining rings 118 are placed on either end of the bushing 114 in order to maintain the longitudinal position of the bushing 114 along the bar 110. An optional grease zerk (not shown) may also be disposed on the outer surface of the bushing 114 in order to provide lubricant to the inner surface of the bushing 114. An eyelet 116 is connected to the bushing 114. The eyelet 116 is shown welded to the outer surface of the bushing 114. The eyelet 116 is shown receiving a hook 300 from a hoisting system. While a bushing 114 and eyelet 116 arrangement is presented as the hoisting connector, it is understood that any other arrangement is within the scope of the present invention so long as the hoisting connector permits the bar 110 to rotate, or "swivel" about the radial axis of the elongated bar 110.

The transport mechanism 100 of the present invention further comprises a counter-weight 120. The counter-weight may be of any configuration or substance, so long as it is of sufficient mass to counter-balance the knife hub 50. In this respect, the counter-weight 120 is disposed along the bar 110 on an end of the bar 110 opposite to where the hub 50 will be engaged. In the preferred embodiment, the counter-weight 120 defines a compact cylindrical body. The weight is preferably approximately 100 pounds with the mass evenly distributed across the body 120.

In order to serve the counter-balancing function, the counter-weight 120 must be slidable along the longitudinal axis of the bar 110. To accomplish this purpose, a counter-weight connector 124 is provided. In the depiction of FIG. 4, the counter-weight connector 124 defines a tubular bushing. The bushing 124 is radially disposed about a portion of the bar 110. To accommodate the movement of the bushing 124 along the bar 110, the bushing 124 preferably employs a highly polished inner surface. In one arrangement, the inner surface (not shown) defines a Teflon coating. As with the hoisting connector 114, the counter-weight connector 124 is dimensioned to rotate about the elongated bar 110.

As noted, the counter-weight 120 is designed to slideably move along the bar 110. To aid in this manipulation, an optional handle 128 is provided. In the depiction of FIG. 4, the handle 128 is disposed on the bushing 124. However, it is understood that the handle 128 may be connected to the counter-weight 120 itself. Further, the handle 128 may be of any configuration.

The counter-weight 120 must be connected to the counter-weight connector 124. In the arrangement shown in FIG. 4, connection is made by welding the metal tools 120, 124. However, any means of connection is within the scope of the present invention. Further, it is within the scope of the present invention to not employ a separate connection device. In this respect, the counter-weight connector could define simply a bore fabricated along the length of the counter-weight 120 itself (arrangement not shown), so long as the bar 110 is able to rotate within the bore. In such an arrangement, the bore itself would serve as the counter-weight connector.

It is desirable to be able to selectively fix the position of the counter-weight 120 longitudinally along the elongated bar 110. To aid in this selective positioning, an optional stop member 134' may be fabricated into the elongated bar 110. The stop member 134' may be of any arrangement, such as a simple groove machined into the bar 110 in order to provide frictional or gravitational resistance to movement of the counter-weight 120. In the arrangement of FIG. 4, the stop member 134' defines a through-opening machined into the bar 110. The through-opening is configured to receive a locking pin 126. The locking pin 126 may be positioned anywhere upon either the counter-weight 120 or the counter-weight connector 124, so long as the locking pin 126 is able to access the corresponding through-opening 134' within the bar 110. In the arrangement shown for a transport mechanism 100 of FIG. 4, the locking pin 126 is disposed upon an end of the counter-weight 120.

Figure 6:
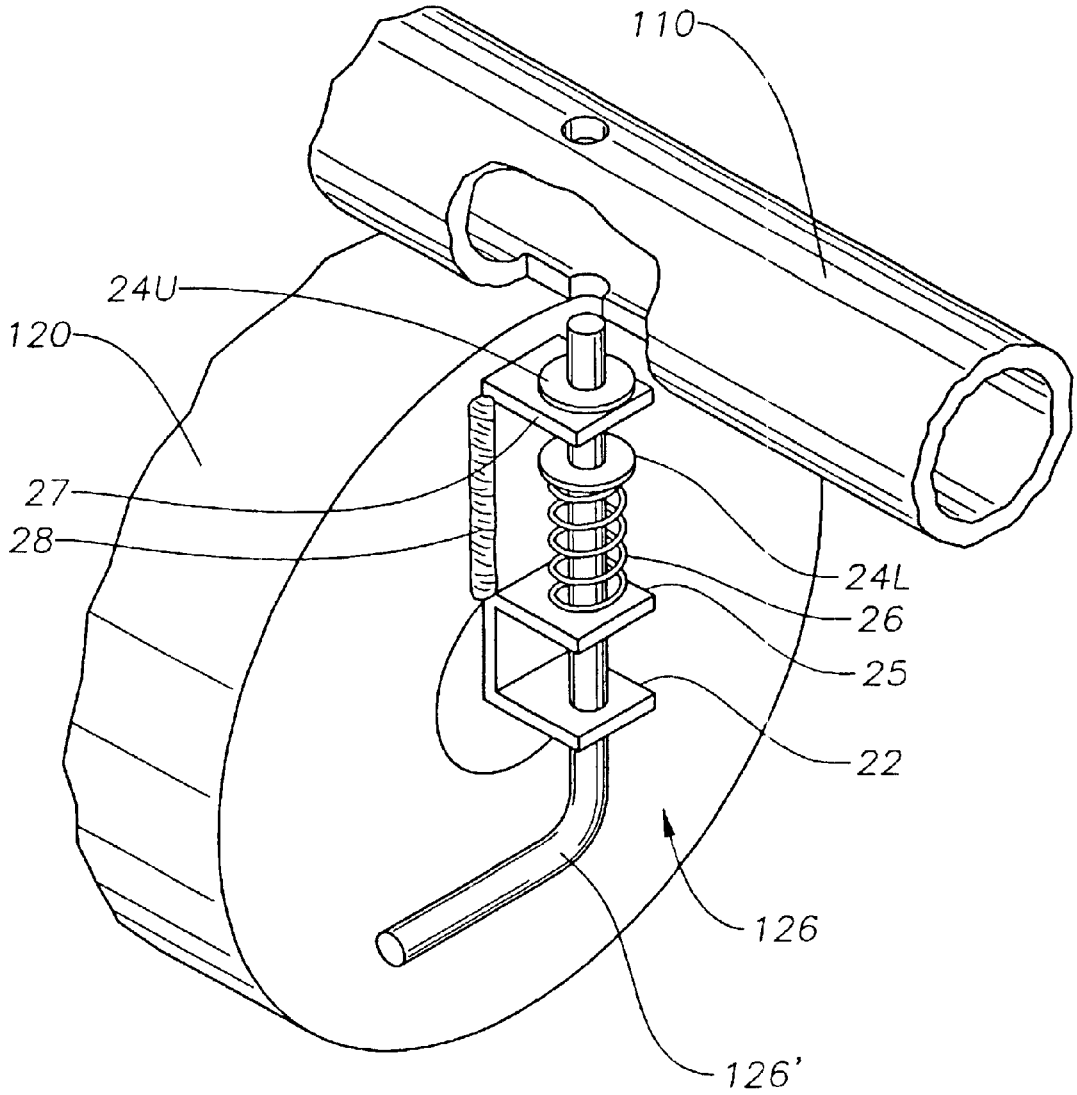
FIG. 6 presents an enlarged view of a locking pin as might be used for fixedly positioning the counter-weight along the transport mechanism of FIG. 4.

FIG. 6 presents an enlarged view of a locking pin 126 as might be used as part of the connector for connecting the counter-weight 120 to the bar 110. The locking pin 126 first comprises a pin member 126'. The pin member 126' is supported by a mounting bracket 22. The mounting bracket 22 has a back surface 28 welded to the end of the counter-weight 120. A spring 26 is positioned around the pin member 126' intermediate opposing ends of the mounting brackets 22. More specifically, the spring 26 is held in compression between a mounting bracket spring stop 25 and a pin member spring stop 27. The spring 26 biases the pin member 126' upward into engagement with the elongated bar 110. The locking pin arrangement 126 includes a lower spring cap 24L to aid in applying further compression to the spring 26 during pin 126' release. The locking pin 126 also includes an upper cap 24U disposed on the pin member 126'. The upper cap 24U serves as a shoulder for the pin member 126' once it is received within a through-opening, e.g., 134'.

It is understood that other arrangements for a locking pin 126 may be provided. The locking pin 126 presented in FIG. 6 is merely exemplary. Any arrangement which allows the counter-weight 120 to be selectively fixed in longitudinal position along the elongated bar 110 is within the scope of the present invention.

FIG. 4 presents more than one through-opening 134', 134" for receiving the pin member 126' of the locking pin 126. The number and placement of through-openings 134', 134" will vary depending upon the weight of the knife hub 50. In the preferred embodiment, a first through-opening 134' is position proximate to the hoisting connector 114. A second through-opening 134" is positioned proximate to the end of the bar 110 opposite of where the hub 50 is to be engaged. The first 134' and second 134" through-openings are radially offset by approximately 90 degrees to permit rotation of the transport mechanism 100 and attached hub 50 during servicing or other handling of the pelletizer knife hub 50.

Figure 5:
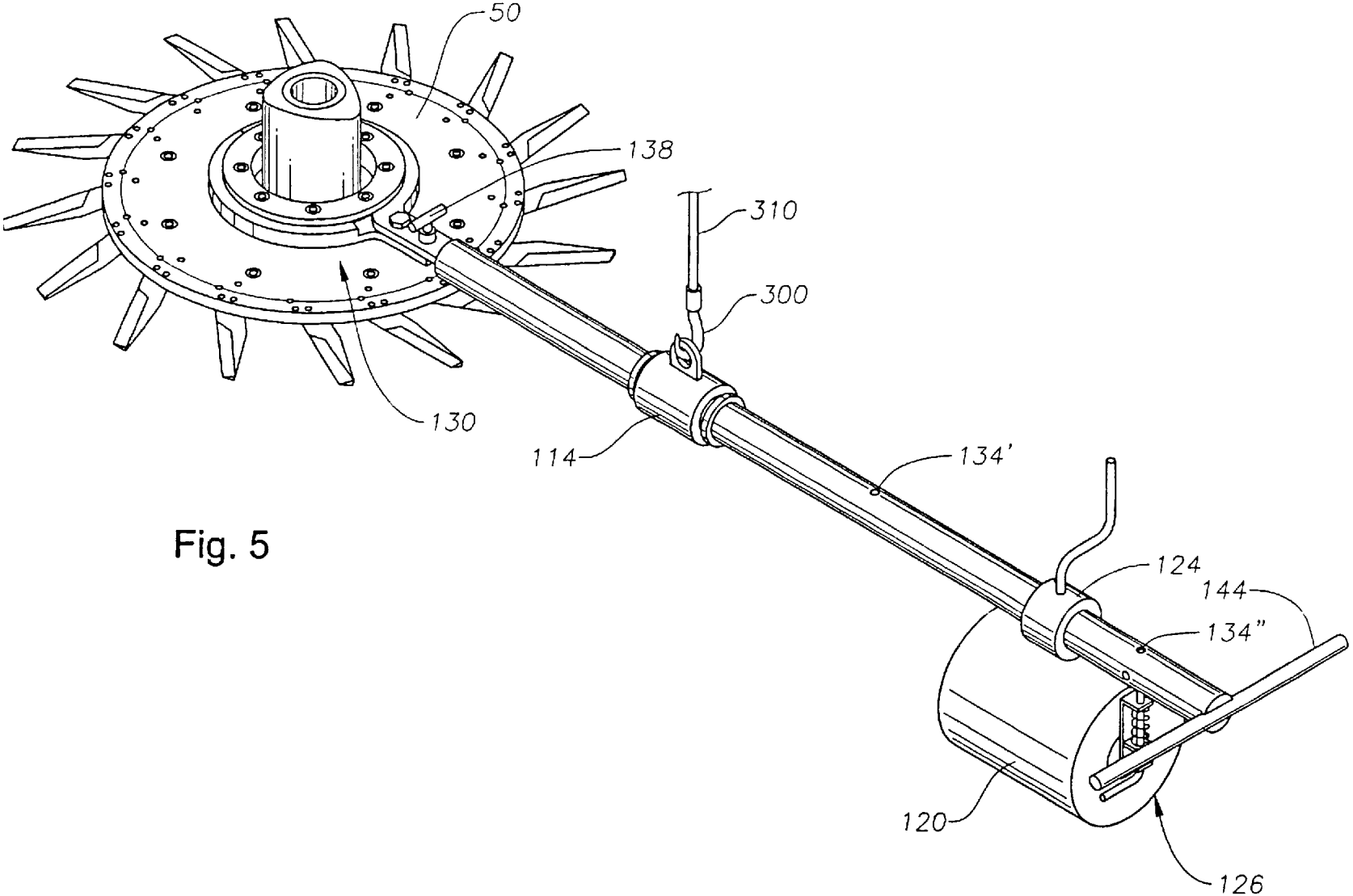
FIG. 5 presents a perspective view of the transport mechanism of FIG. 4. The transport mechanism has been rotated 90 degrees relative to the hoisting system.

FIG. 5 presents a perspective view of the transport mechanism 100 of FIG. 4. In this view, the bar 110 has been rotated 90 degrees. In addition, the counter-weight 120 has been moved along the bar 110 to its second end position. The locking pin 126 is now engaged with the second through-opening 134".

It can be seen from FIG. 5 that the bar 110 and attached connectors 114, 124 are able to swivel. This swiveling feature is one of the novel aspects of the transport mechanisms of the present invention. To aid in this swiveling, an optional handle 144 is shown attached to an end of the bar 110. The handle 144 may be of any configuration.

The hub mechanism 100 of FIGS. 4 and 5 further comprises a hub clamp 130. The clamp includes opposing clamp members 132, 134. The clamp members 132, 134 are connected at a proximate end by a pin or bolt 136. A separate T-bolt 138 is used to fix the position of the clamp members 132, 134 when they engage the shaft 56' of the knife hub 50. In this respect, those of ordinary skill in the art will understand that the clamp 130 selectively opens and closes in order to engage and release the shaft 56' of the pelletizer knife hub 50.

The clamp 130 is fixed at an end of the elongated bar 110 opposite the counter-balance 120. When the clamp 130 is dormant, i.e., not supporting a pelletizer knife hub 50, the counter-weight 120 is in its first position proximate to the hoisting connector 114. The locking pin 126 is inserted into the first stop member 134' in order to fix the position of the counter-weight 120 proximate to the hoisting connector 114. However, when the clamp 130 engages and supports the hub 50, the counter-weight 120 is slid longitudinally along the bar 110 to its second position. To accomplish this repositioning, the locking pin 126 is released from the first stop member 134', and is inserted into the second stop member 134" proximate the end of the bar 110. In this way, the transport mechanism 100 remains dynamically balanced.

Figure 7:
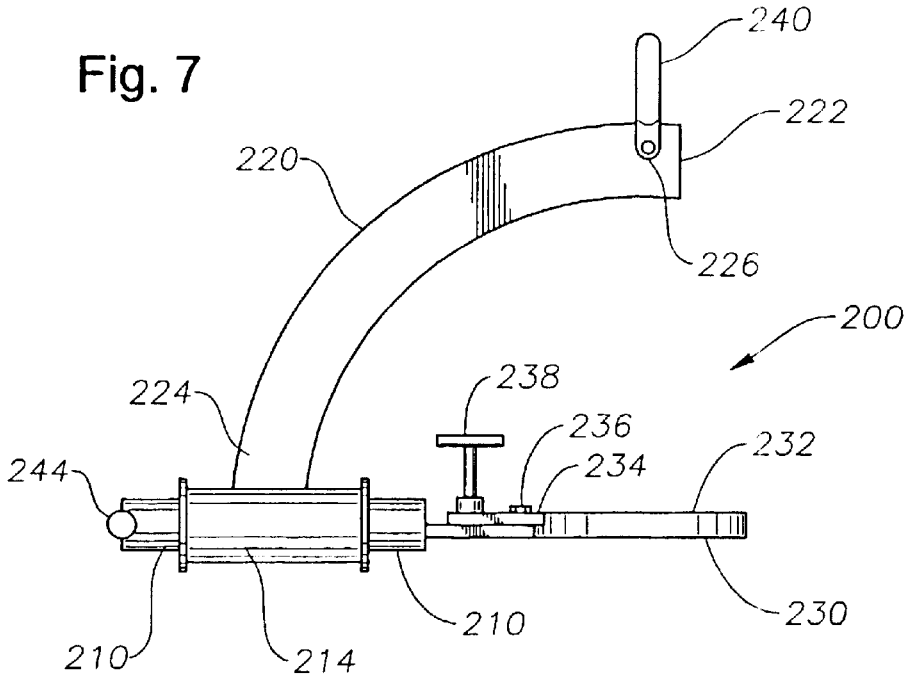
FIG. 7 presents a side view of an alternate arrangement for a pelletizer knife hub transport mechanism.
Figure 8:
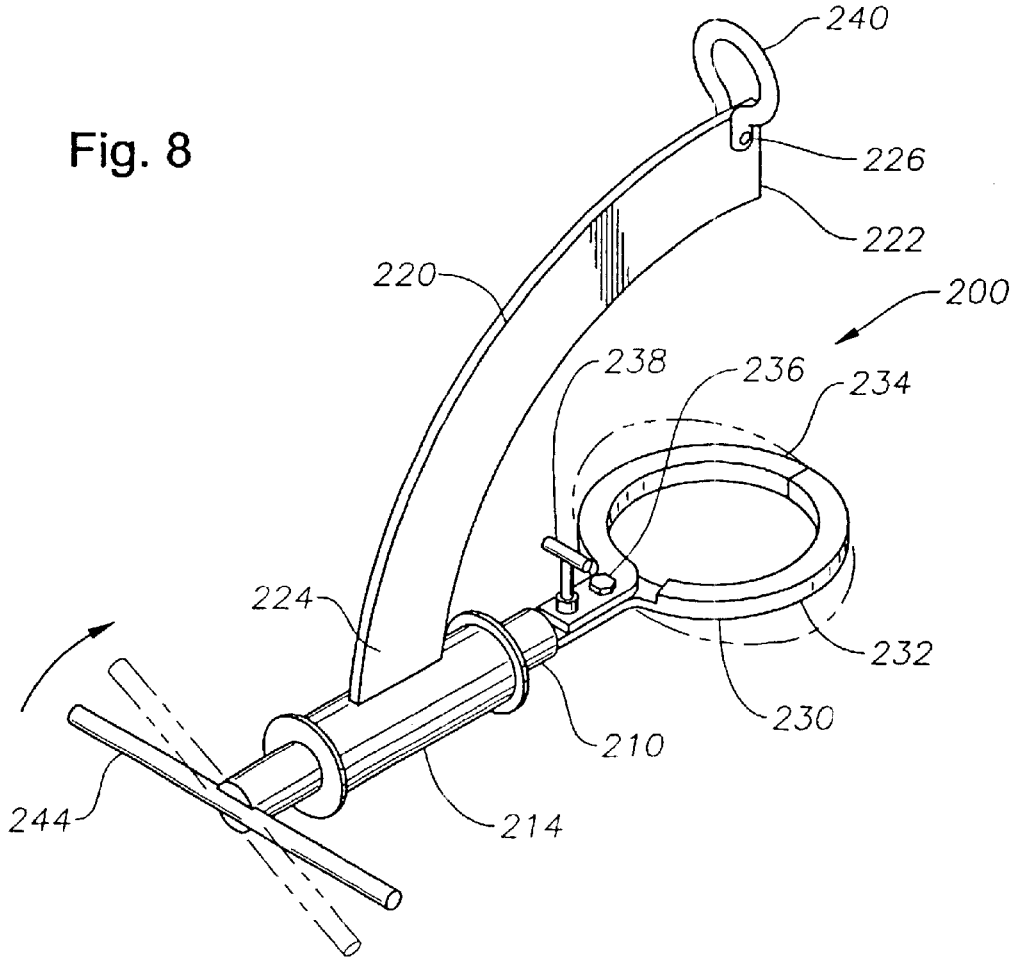
FIG. 8 is a perspective view of the transport mechanism of FIG. 7.

An alternate arrangement for a pelletizer knife hub transport mechanism 200 is shown in FIG. 7. FIG. 7 presents a side view of a separate transport mechanism 200. FIG. 8 presents the transport mechanism 230 of FIG. 7, in perspective view.

The transport mechanism 200 of FIGS. 7 and 8 share certain components with the transport mechanism 100 of FIGS. 4 and 5. First, transport mechanism 200 includes a clamp 230. As with clamp 130, clamp 230 presents opposing clamp members 232, 234, which swivel about a bolt or pin 236. A locking T-bolt 238 is provided in order to selectively fix the clamp members 232, 234 in a closed position.

Transport mechanism 200 also includes an optional handle 244 opposite the clamp 230. As with handle 144, handle 244 aids in the rotational movement of the clamp 230.

The transport mechanism 200 further comprises an arcuate support bar 220. The support bar 220 is fabricated from a material of sufficient strength to support both the transport mechanism 200 and an engaged pelletizer knife hub 50 (not shown in FIGS. 7 and 8). Preferably, steel or other strong metal alloy is employed. The support bar 220 is preferably configured to define a 90-degree arc.

At an upper end 222 of the support bar 220 is disposed a hoisting connector 226. The connector 226 is configured to receive a hook (not shown) from a hoisting system. For example, a simple through-opening 222 may be employed. In the arrangement of FIG. 7 and FIG. 8, a separate shackle 240 is utilized. In this respect, the shackle 240 is supported within a through-opening 222 of the arcuate support bar 220, and is configured to receive a hook from the hoisting system (not shown).

At a lower end 224 of the support bar 220 is a clamp connector 214. The clamp connector 214 serves to connect the support bar 220 with the transport clamp 230. In the arrangement of FIGS. 7 and 8, the clamp connector 214 defines a tubular bushing. The tubular bushing 214 rotates about a shaft 210. The clamp 230 is connected to the shaft 210 at one end, while the optional handle 244 is attached to the shaft 210 at the opposite end.

The bushing 214-and-shaft 210 arrangement allows the clamp 230 to be rotated relative to the arcuate support bar 220. In this respect, the support bar 220 is of sufficient radial dimension to permit an engaged knife hub 50 to be rotated within the circumference of the support bar 220.

In order to provide further stability to the transport mechanism 230, the upper hoisting connector 226 is preferably disposed above the center of the shaft of the pelletizer knife hub 50 when the clamp 230 engages the shaft 56'. In this way, the transport mechanism 200 is provided greater stability and balance.

As can be seen, an improved transport mechanism for a pelletizer knife hub has been disclosed. More specifically, various embodiments for a transport mechanism enjoying advantages and features over the transport mechanism of the prior art have been presented. It is preferred that the transport mechanisms 100, 200 disclosed herein and their legal equivalents, will operate to transport a KOBE™ brand pelletizer knife hub. However, the transport mechanisms of the present invention are not limited in their utility and application to any one particular style or brand of pelletizer knife hub. Further, the transport mechanisms 100, 200 are not limited in their utility by the number of knives 52 on the hub 50. Further, the transport mechanisms have utility in transporting any wheel system having a shaft. It is, therefore, understood that the particular arrangements presented here and described herein arc not limiting of the scope of the invention, but are merely for example and explanation. Moreover, all patents and other documents cited herein, including priority documents, are incorporated by reference herein.

What is claimed is:

1. A hub transport mechanism, the hub having a shaft, the hub transport mechanism comprising:

an elongated bar having a first end and a second end;

a clamp configured to engage the shaft of the hub, the clamp disposed at the first end of the elongated bar;

a hoisting connector residing on the elongated bar intermediate the first end and the second end, the hoisting connector being configured to receive a connector from a hoisting system, and being configured to swivel about the radial axis of the elongated bar;

a counter-weight; and a counter-weight connector for connecting the counter-weight to the elongated bar, the counter-weight connector permitting slidable movement of the counter-weight along the elongated bar proximate to the second end, the counter-weight connector also being configured to swivel about the radial axis of the elongated bar.

2. The hub transport mechanism of claim 1, wherein the elongated bar is a tubular body having a substantially circular cross-section.

3. The hub transport mechanism of claim 2, wherein the hub is a hub for a pelletizer knife hub, the pelletizer knife hub having a plurality of knives radially disposed around a circumferential body of the hub.

4. The hub transport mechanism of claim 3, wherein the hoisting connector comprises:

a bushing; and an eyelet connected to the bushing for receiving the connector from the hoisting system.

5. The hub transport mechanism of claim 4, wherein the connector from the hoisting system defines a hook.

6. The hub transport mechanism of claim 3, wherein the counter-weight connector defines a bushing that swivels around the elongated bar.

7. The hub transport mechanism of claim 6, further comprising a counter-weight handle for guiding the counter-weight longitudinally as it is moved along the elongated bar.

8. The hub transport mechanism of claim 3, further comprising a handle at the second end of the elongated bar for rotating the elongated bar and attached clamp.

9. The hub transport mechanism of claim 3, further comprising at least two counter-weight connector stop members disposed along the elongated bar between the hoisting connector and the second end of the elongated bar, for fixedly positioning the counter-weight.

10. The hub transport mechanism of claim 9, wherein the counter-weight connector stop members define grooves in the elongated bar.

11. The hub transport mechanism of claim 10, wherein the grooves define through-openings in the elongated bar.

12. The hub transport mechanism of claim 11, further comprising a locking pin, the locking pin having an end received in any of the at least two counter-weight connector stop members for selectively fixing the longitudinal position of the counter-weight.

13. The hub transport mechanism of claim 12, wherein a first of the at least two counter-weight connector stop members is disposed proximate to the hoisting connector, and a second of the at least two counter-weight stop members is disposed proximate to the second end of the elongated bar, the first and second through-openings being offset around the elongated bar approximately 90 degrees.

14. The hub transport mechanism of claim 13, wherein the locking pin is disposed on the counter-weight.

15. The hub transport mechanism of claim 4, wherein the elongated bar further comprises retaining rings for retaining the longitudinal position of the hoisting connector along the elongated bar.

16. A pelletizer knife hub transport mechanism, the pelletizer knife hub having a shaft, and having a plurality of knives radially disposed around the hub, the transport mechanism comprising:

an elongated bar having a first end and a second end;

a transport clamp configured to engage the shaft of the pelletizer knife hub, and disposed at the first end of the elongated bar;

a hoisting connector residing on the elongated bar intermediate the first end and the second end, the hoisting connector defining a tubular bushing disposed around a portion of the elongated bar, for receiving a hook from a hoisting system;

a counter-weight; and a counter-weight connector for connecting the counter-weight to the elongated bar, the counter-weight connector defining a tubular bushing disposed around a portion of the elongated bar, and permitting rotational movement of the elongated bar therein.

17. The pelletizer knife hub transport mechanism of claim 16, wherein the elongated bar defines a tubular body having a substantially circular cross-section.

18. The pelletizer knife hub transport mechanism of claim 17, wherein the hoisting connector further comprises an eyelet connected to the bushing for receiving the hook from the hoisting system.

19. The pelletizer knife hub transport mechanism of claim 18, further comprising a handle at the second end of the elongated bar to assist in rotating the elongated bar and attached shaft.

20. The pelletizer knife hub transport mechanism of claim 19, further comprising first and second through-openings within the elongated bar, the first through-opening being disposed proximate to the hoisting connector opposite the clamp, and the second through-opening being disposed proximate to the second end of the elongated bar, the first and second through-openings being offset approximately 90 degrees; and a locking pin disposed on the counter-weight, the locking pin having an end receivable within either of the first or second through-openings so as to selectively fix the position of the counter-weight longitudinally along the elongated bar.

21. A pelletizer knife hub transport mechanism, the pelletizer knife hub having a shaft, and having a plurality of knives radially disposed around a body of the hub, the transport mechanism comprising:

a support bar having a radial axis about which the bar may rotate or swivel;

a hoisting connector attached to the support bar for receiving a hook from a hoisting system; and a clamp for engaging the shaft of the pelletizer knife hub, the clamp being connected to the support bar, and being rotatable relative to the hoisting system.

22. The pelletizer knife hub transport mechanism of claim 21, wherein the support bar defines an elongated bar; and wherein the pelletizer knife hub transport mechanism system further comprises a counter-balance movably disposed along the elongated bar opposite the clamp.

* * * * *